US007992854B2

(12) United States Patent
Mandel et al.

(10) Patent No.: US 7,992,854 B2
(45) Date of Patent: Aug. 9, 2011

(54) SHEET BUFFERING SYSTEM

(75) Inventors: Barry P. Mandel, Fairport, NY (US); Henry T. Bober, Jr., Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 51 days.

(21) Appl. No.: 12/549,106

(22) Filed: Aug. 27, 2009

(65) Prior Publication Data

US 2011/0049784 A1 Mar. 3, 2011

(51) Int. Cl.
*B65H 37/04* (2006.01)

(52) U.S. Cl. ..... 270/58.01; 270/58.08; 270/58.11; 270/58.18; 271/225; 271/186; 271/184

(58) Field of Classification Search ..... 270/58.01, 270/59, 58.08, 58.11, 58.17, 58.18; 271/225, 271/184, 185, 186
See application file for complete search history.

(56) References Cited

U.S. PATENT DOCUMENTS

| | | | | |
|---|---|---|---|---|
| 4,986,529 | A * | 1/1991 | Agarwal et al. | 271/291 |
| 5,289,251 | A | 2/1994 | Mandel et al. | |
| 6,022,011 | A * | 2/2000 | Hirose | 270/37 |
| 6,199,853 | B1 * | 3/2001 | Andoh et al. | 270/58.14 |
| 6,719,283 | B2 * | 4/2004 | Tsuchiya et al. | 270/58.07 |
| 6,997,451 | B2 * | 2/2006 | Yoshimura et al. | 270/58.12 |
| 7,136,616 | B2 | 11/2006 | Mandel et al. | |
| 2002/0096822 | A1 * | 7/2002 | Glemser et al. | 271/186 |
| 2003/0071409 | A1 * | 4/2003 | Sumi et al. | 271/186 |
| 2007/0120308 | A1 * | 5/2007 | Takemoto et al. | 270/37 |

* cited by examiner

*Primary Examiner* — Patrick Mackey

(57) ABSTRACT

A combined sheet inverting and buffering system and method including a sheet drive for transporting sheets into a sheet collecting area. The sheet drive is selectively operable to transport the sheets in a first and second direction along a processing path. A holding device can hold a plurality of sheets. The sheet drive and holding device cooperate to compile the plurality of sheets into a stack wherein the sheets overlie each other in a shingled manner. A take away drive is in operative communication with the sheets for individually unloading the sheets from the sheet collecting area.

21 Claims, 22 Drawing Sheets

SHEET BUFFERING SYSTEM

TECHNICAL FIELD

The presently disclosed embodiments are directed to buffering sheets within a printing machine.

BACKGROUND

Document processing jobs often require the printing of monochromatic sheets including black and white printed images, such as text, and sheets having color images, such as pictures, charts and other graphics. For example, the job may require that sheets with color pictures be inserted between sheets having black and white text images. In order to accommodate both black and white images and color images; document processing systems may incorporate at least one print engine for imparting black and at least one other separate print engine for imparting colors. Tightly integrated multi-engine printing systems such as those described in U.S. Pat. No. 7,136,616 could achieve this function using an integrated media path system.

In a tightly integrated document processing system, the sheets would typically be printed sequentially. If a sheet having a black and white image were printed followed by a sheet having a color image, the print engine for the color image would be cycled on to generate the color image. In this way, the sheet could be fed in a sheet processing stream and be positioned correctly within the output set of sheets. In a document processing job where the color sheets were relatively few, the color print engine would be turned on to generate one or a few sheets and then cycled down. The print engine would then be cycled up again when the next color sheet or sheets were needed. Accordingly, the color print engine may need to be cycled up and down many times during a processing job. An alternative option is to cycle up the color engine once and allow it to dead cycle while the monochrome prints are being printed. When dead cycling, the color engine is running but not producing prints.

Print engines, especially the expensive life limited photo receptor elements, are subject additional wear and tear upon each cycling up and down or any non-printing dead cycles. However, once a print engine is cycled on, a number of sheets may be processed with nominal wear on the print engine. In a document processing job where color sheets are infrequently dispersed through out the document, the color print engine must be cycled on and off frequently thereby leading to significant additional wear on the print engine resulting in a shortened effective photo receptor life and an increase run cost per printed page.

Document processing machines have been devised to address the high on/off cycling of the print engines. A number of sheets are processed at a time and then stored in a buffer unit. The buffer unit may be disposed adjacent a sheet inverting unit. A buffer unit may include a number of media paths where sheets can be stored and inserted into the processing steam as needed. However, such buffering devices require additional processing stations to be added to the document processing machine, thereby increasing the complexity, the cost and the footprint of the machine.

Accordingly, it would be desirable to provide a compact buffering system to reduce the wear on the print engines without adding additional footprint or significant complexity to the machine.

SUMMARY

There is provided a system for buffering sheets of substrate media including a first sheet drive for transporting sheets into a sheet collecting area. A second sheet drive is selectively operable to transport the sheets in a first and second direction along a processing path. A holding device is provided for holding a plurality of sheets. The second sheet drive and holding device cooperate to compile the plurality of sheets into a stack wherein the sheets overlie at least a portion of each other in a shingled manner. A take away drive is in operative communication with the sheets for unloading the sheets from the sheet collecting area, wherein the sheets exiting the collecting area are inverted with respect to their original orientation.

There is further provided a sheet handling device including a first sheet path and a second sheet path. The first and second sheet paths cooperate to invert a sheet. A sheet collecting area is disposed along the second sheet path for holding and buffering sheets. An first sheet drive is provided for moving media toward the sheet collecting area. A second sheet drive is provided for moving the sheets in a first and second direction along the second path. A holding device is provided for retaining the sheets in a predetermined position. The second sheet drive and holding device cooperate to form a stack of sheets having edges offset from each other in a shingled manner.

There is still further provided a method of buffering sheets including:

transporting a first sheet from a sheet processing stream toward a sheet drive;

transporting the first sheet in a first direction into a sheet collecting area;

transporting the first sheet in a second direction along a processing path toward and into a first holding device;

retaining the first sheet in the sheet collecting area with the first holding device;

transporting a second sheet from the sheet processing stream into the sheet collecting area and toward the sheet drive;

transporting the second sheet in the second direction along the processing path toward and into the first holding device;

holding the first and second sheets in the sheet collecting area, wherein the second sheet overlies at least a portion of the first sheet; and selectively transporting the first and second sheets along the processing path out of the sheet collecting area and back into the sheet processing stream one at a time.

DETAILED DESCRIPTION

The following terms shall have, for the purposes of this application, the respective meanings set forth below.

As used herein the term "sheet processing stream" refers to a path along which substrate media travels through a document processing machine.

As used herein the term "nip" refers to a location in a document processing device at which a sheet is propelled in a process direction. A nip may be formed between an idler wheel and a drive wheel of a nip assembly.

As used herein the term "sheet collecting area" refers to a space in which sheets may be gathered and held.

As used herein the term "overlies" refers to lie over or upon.

As used herein the term "shingled manner" refers to one sheet partially overlying and extending beyond an adjacent sheet in a direction of media travel.

As used herein the term "sheet drive" refers to a device for moving a sheet along a path, including but not limited to, a drive nip assembly, belt transports, vacuum transports or translating clamp systems.

As used herein the term "holding device" refers to a device which retains the position of sheets, including but not limited to a nip assembly or clamp.

As used herein the term "take away drive" refers to a device for transporting a sheet out of a device such as the sheet collecting area. The device may include a drive nip assembly, belt transports, vacuum transports or translating clamp systems.

As used herein the term "processing path" refers to a path within a sheet holding device over which sheets may travel.

As used herein the term "sheet path" refers to a passage over which sheets of media may travel.

As user herein the term "invert" refers to reversing the orientation of an object such as a sheet.

Figure 1:
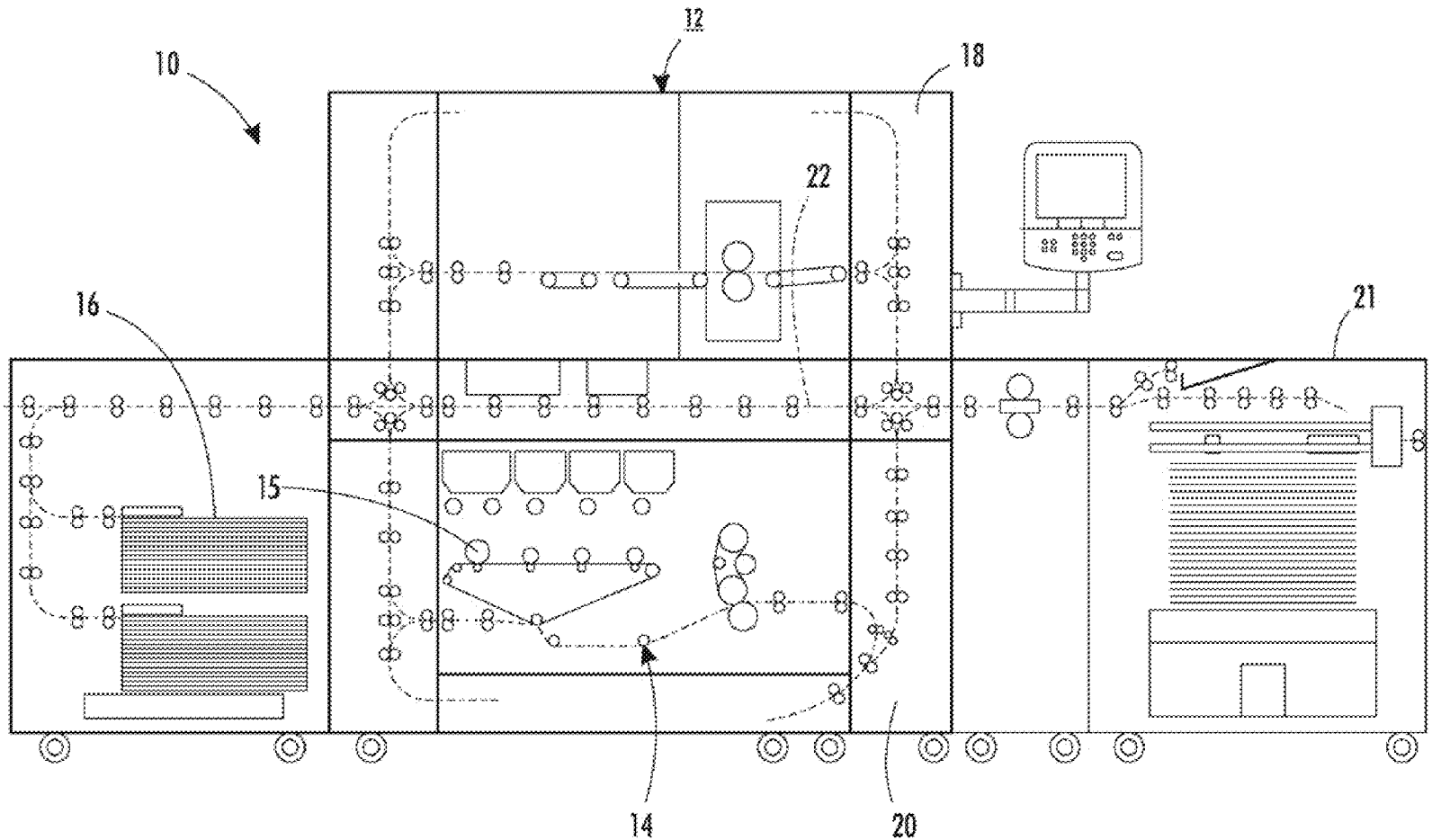
FIG. 1 is a schematic view of a document processing machine including a buffering system of the present invention.

The present disclosure relates to buffering processed substrate media and selectively releasing the media into a process stream. With reference to FIG. 1, a document processing device 10 may include a first and second print engine 12, 14 for imparting an image on substrate media, such as sheets of paper 16. The first print engine 12 may be used to for monochromatic processing, e.g., black and white images, and the second print engine 14 may include a plurality of stations 15 for processing multi-color images.

Figure 2:
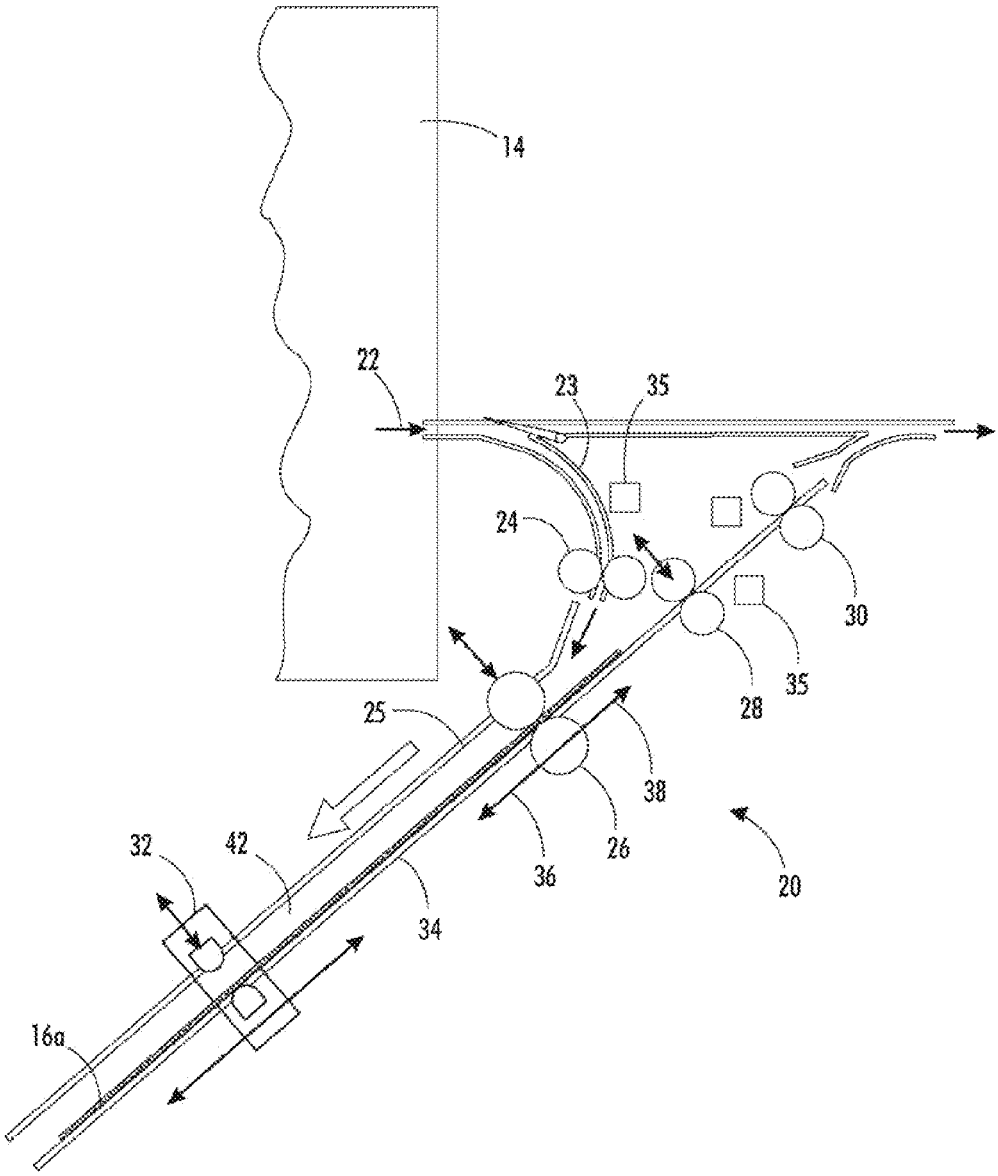
FIGS. 2-10 are schematic views of an embodiment of a sheet inverter/buffer depicting various stages of processing substrate media.

With further reference to FIG. 2, upon exiting the print engines 12, 14, the sheets 16 travel along a path and may be diverted toward a sheet inverter. Each print engine may have a corresponding inverter, wherein inverter 18 corresponds to print engine 12, and inverter 20 corresponds to print engine 14. The inverters 18, 20 turn over or invert the sheets 16 so that a desired side of the sheet is facing in a desired direction. The inversion of the sheets performed by the inverters 18, 20 may also include reversing the sheets such that the leading edge becomes the trailing edge and the trailing edge become the leading edge. After a sheet is inverted, it may reenter the processing stream 22 and be transported for further processing included but not limited to printing of an image on the second side or delivering the sheet to an output device 21.

At least one of the inverters, in addition to turning the sheets may also buffer the sheets and release them into the processing stream at selected times. For the present description, inverter 20 may be configured as a dual functioning inverter/buffer, and is referred to herein as a buffer. It is with in the contemplation of the present disclosure that inverter 18 could alternatively, or also, be configured as an inverter/buffer. The buffer 20 may, therefore, be incorporated into a document processing machine with out adding additional processing stations.

With reference to FIG. 2, the buffer 20 may include such as an entrance drive 24, an articulated and bidirectional buffer drive 26, an articulated and bidirectional holding device 28, and a take away drive 30. In a preferred embodiment, the entrance 24, buffer 26 and take away 30 drives and holding device 28 may included a nip assembly. Accordingly, for explanation purposes the drives are referred to herein as nip assemblies. Each nip assembly may include one or more drive wheels and idlers wheels which form nips therebetween. When a sheet enters the nips the sheets are engaged and transport through the nip. In addition, the buffer 20 may include a set clamp 32 and buffer plate 34. A number of sensors 35 may be placed within the sheet buffer 20 adjacent the nip assemblies in order to determine the position of the sheets.

A first sheet 16*a* exiting first print engine 14 may be diverted from a processing stream 22 toward the buffer 20 along a first processing path 23. First processing path 23 may have a curved arc-like configuration. Travel along the first processing path 23 inverts the sheet such that the face of the sheet is reversed. The diverted sheet 16*a* first encounters an entrance nip assembly 24 which transports the sheet 16*a* further into the buffer 20 into a second processing path 25. The sheet 16*a* then encounters the buffer nip assembly 26. The buffer nip assembly 26 has an open and close position. In the closed position, the buffer nip assembly 26 engages a sheet and is able to translate the sheet in a first 36 and second 38 direction, represented by arrows in FIG. 2, along the second processing path 25. In the open position, sheets may move by action of the other nip assemblies such as entrance nip assembly 24 and holding nip assembly 28 through the buffer nip assembly 26 without being engaged. When the first sheet 16*a* encounters the buffer nip assembly 26, the buffer nip assembly 26 is in the open position which allows the sheet driven by the entrance nip assembly 24 into a substrate media collecting area 42 wherein the inverted sheet is supported by a buffer plate 34. The sheets may be held in the collecting area 42 until they are unloaded therefrom and inserted back into the processing stream 22.

Figure 3:
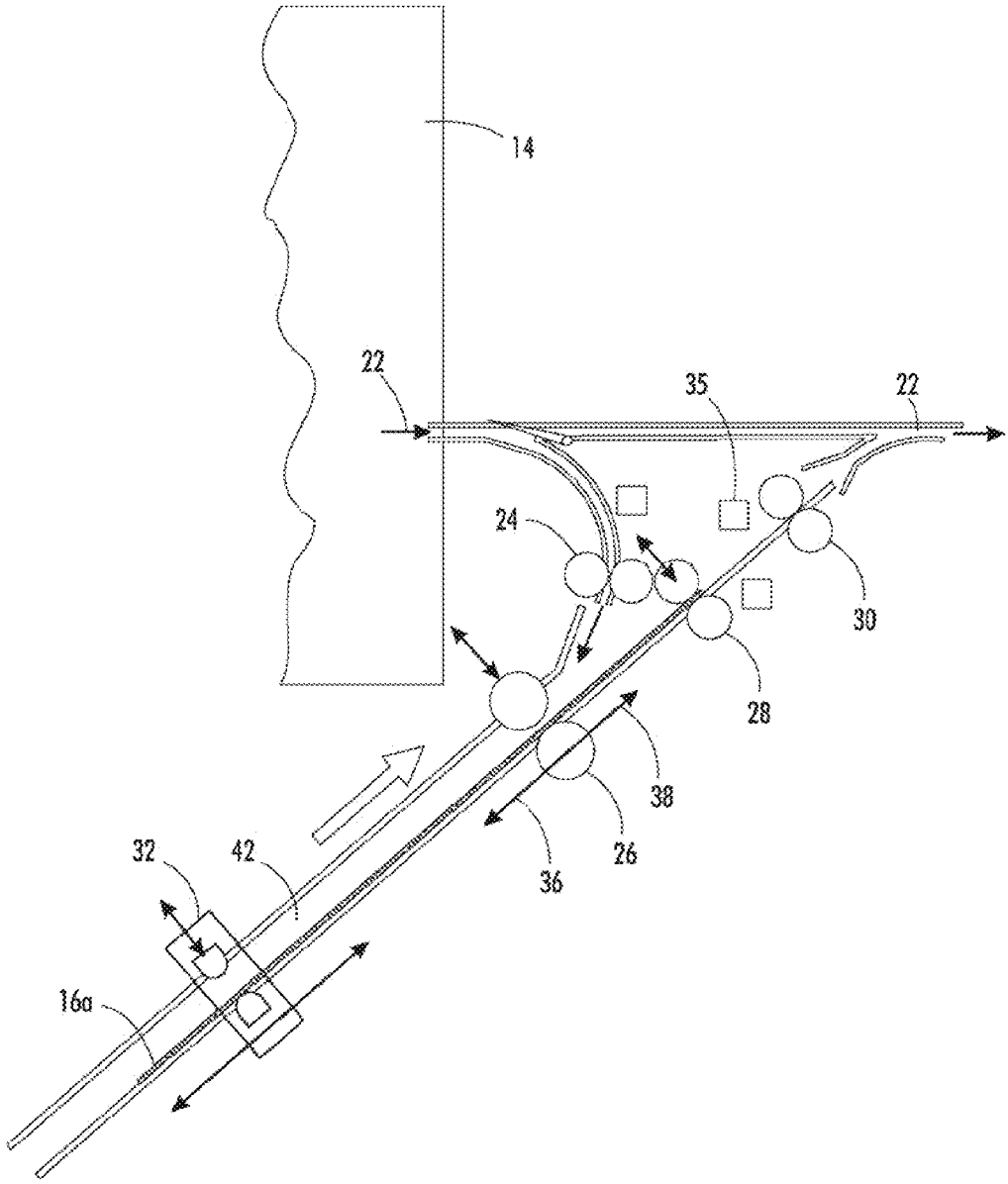

Referring to FIG. 3, after the trailing edge of the first sheet 16*a* has cleared the entrance nip assembly 24, the buffer nip assembly 26 may operate in a drive direction that transports the sheet 16*a* in the second direction 38 toward the holding nip assembly 28. When the direction of the sheet 16*a* is changed from the first direction to the second direction, the trailing edge now becomes the leading edge. Upon the leading edge of the sheet 16*a* entering the holding nip assembly 28, the holding nip assembly 28 is operated to pull the sheet 16*a* into the nip. When the first sheet 16*a* enters the holding nip assembly 28, its operation is stopped and does not further move the sheet. The sheet 16*a* is therefore held or parked with the sheets leading edge being retained by the holding nip assembly 28.

Figure 4:
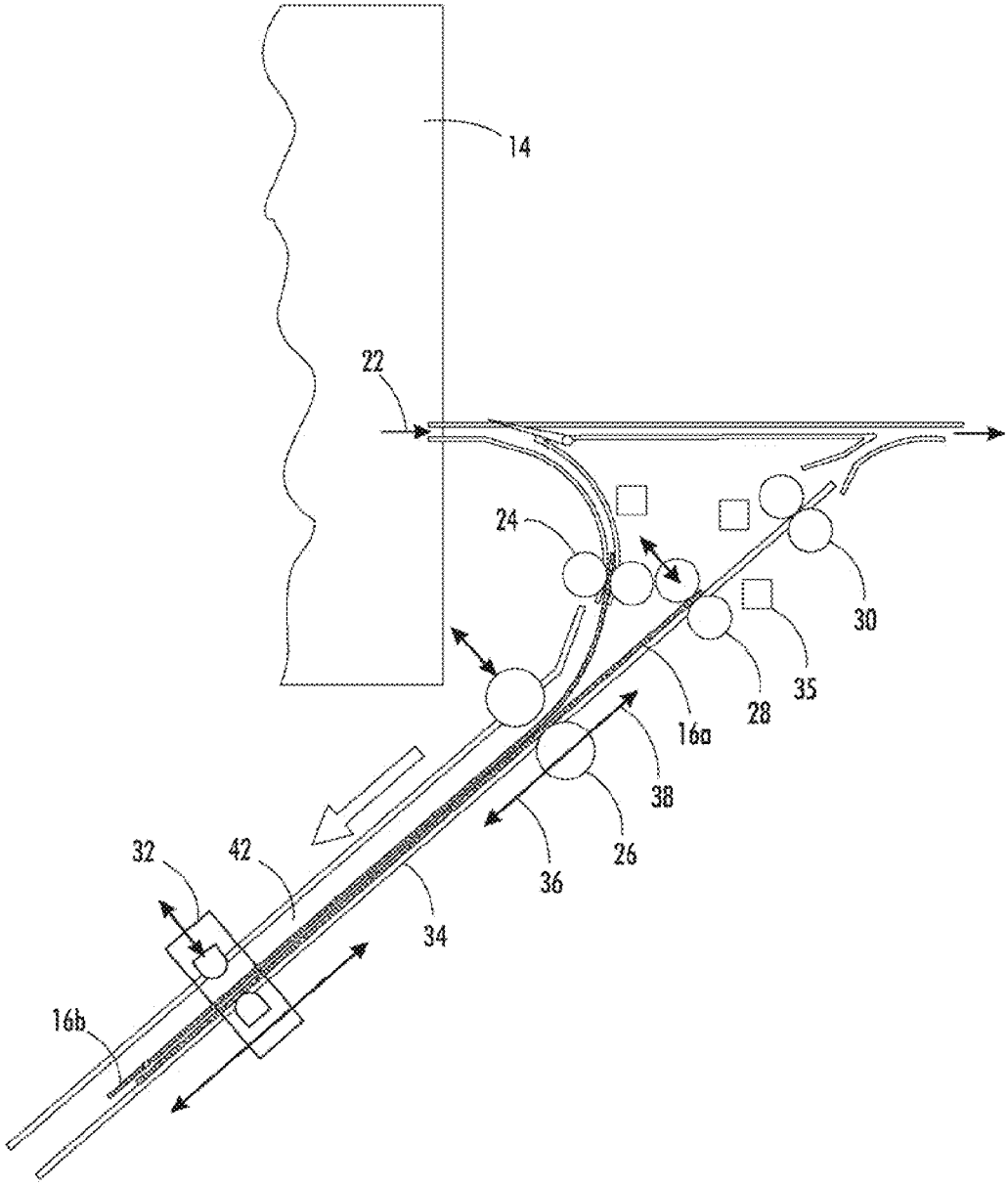

Referring to FIG. 4, with first sheet 16*a* held in place, a second sheet 16*b* is driven by the entrance nip assembly 24 along the first processing path 23 down toward the collecting area 42. As with the first sheet 16*a*, travel of the second sheet along the first processing path 23 inverts the sheet such that the face of the sheet is reversed. The buffer nip assembly 26 is moved to the open position thereby allowing the second sheet 16*b* to slide past the nip unaffected thereby. The second sheet 16*b* may be driven in the first direction 36 by the entrance nip assembly 24 until the trailing edge of the sheet 16*b* is close to leaving the entrance nip assembly 24. At this point, the second sheet 16*b* may optionally be slowed or stopped, while the first sheet 16*a* may be driven in the first direction by the holding nip assembly 28 to match the speed and direction of the second sheet 16*b*.

Figure 5:
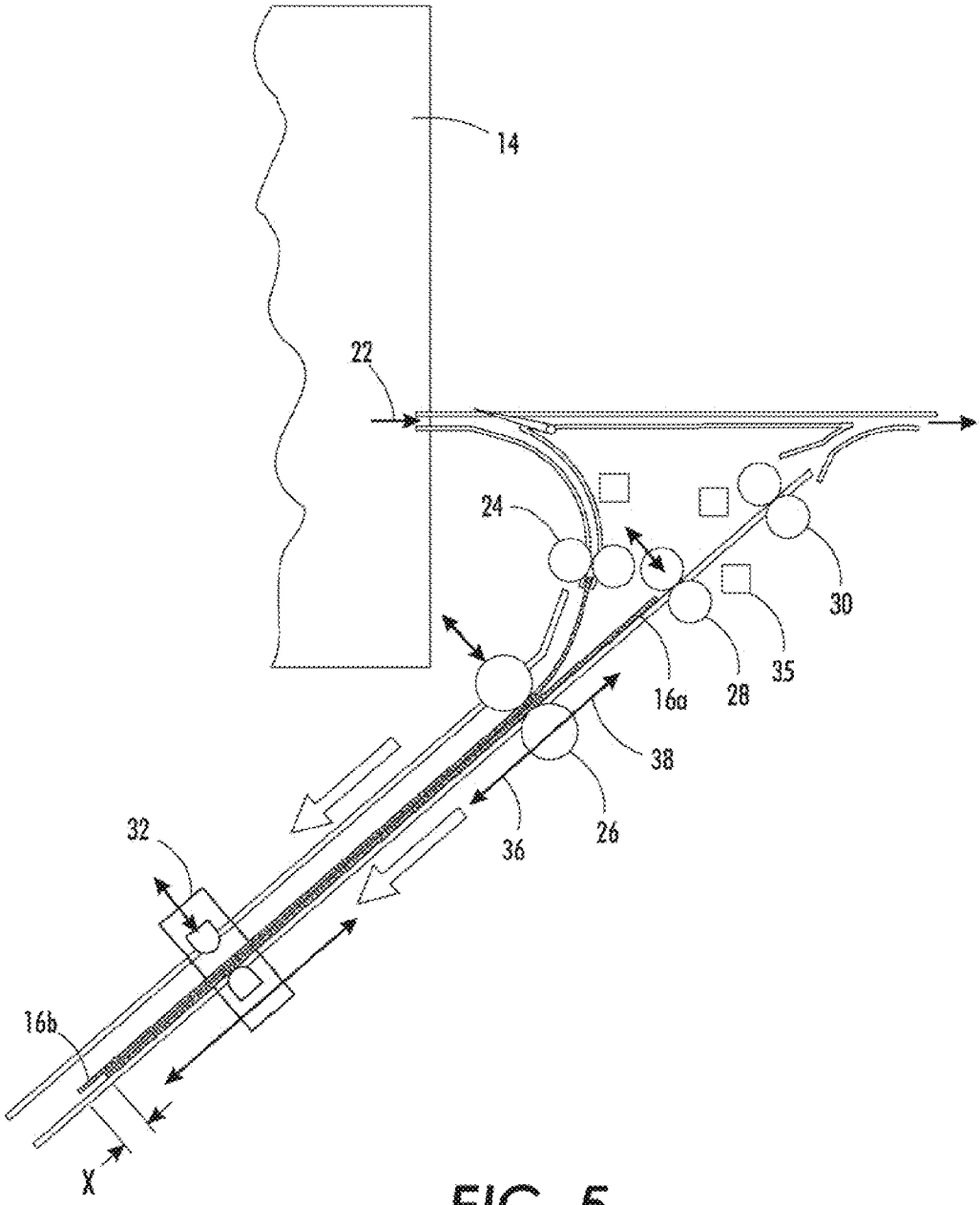

When the trailing edge of the second sheet 16*b* is about to exit the entrance nip assembly 24, as shown in FIG. 5, the buffer nip assembly 26 may close. Both sheets 16*a* and 16*b* are then driven in the first direction 36 by nip assemblies 26 and 28 until the trailing edge of the second sheet clears the entrance nip assembly 24. The second sheet 16*b* upon exiting the entrance nip assembly 24 is positioned such that it overlies at least a portion of the first sheet 16*a*, and the incoming leading edge of the second sheet 16*b* extends further in the first direction 36 than the trailing edge of the first sheet 16*a* by some significant distance "X". Overlap "X" may be in the range of 5 to 25 mm based on the number of sheets that are to be buffered and the geometry chosen for the buffer station elements.

Figure 6:
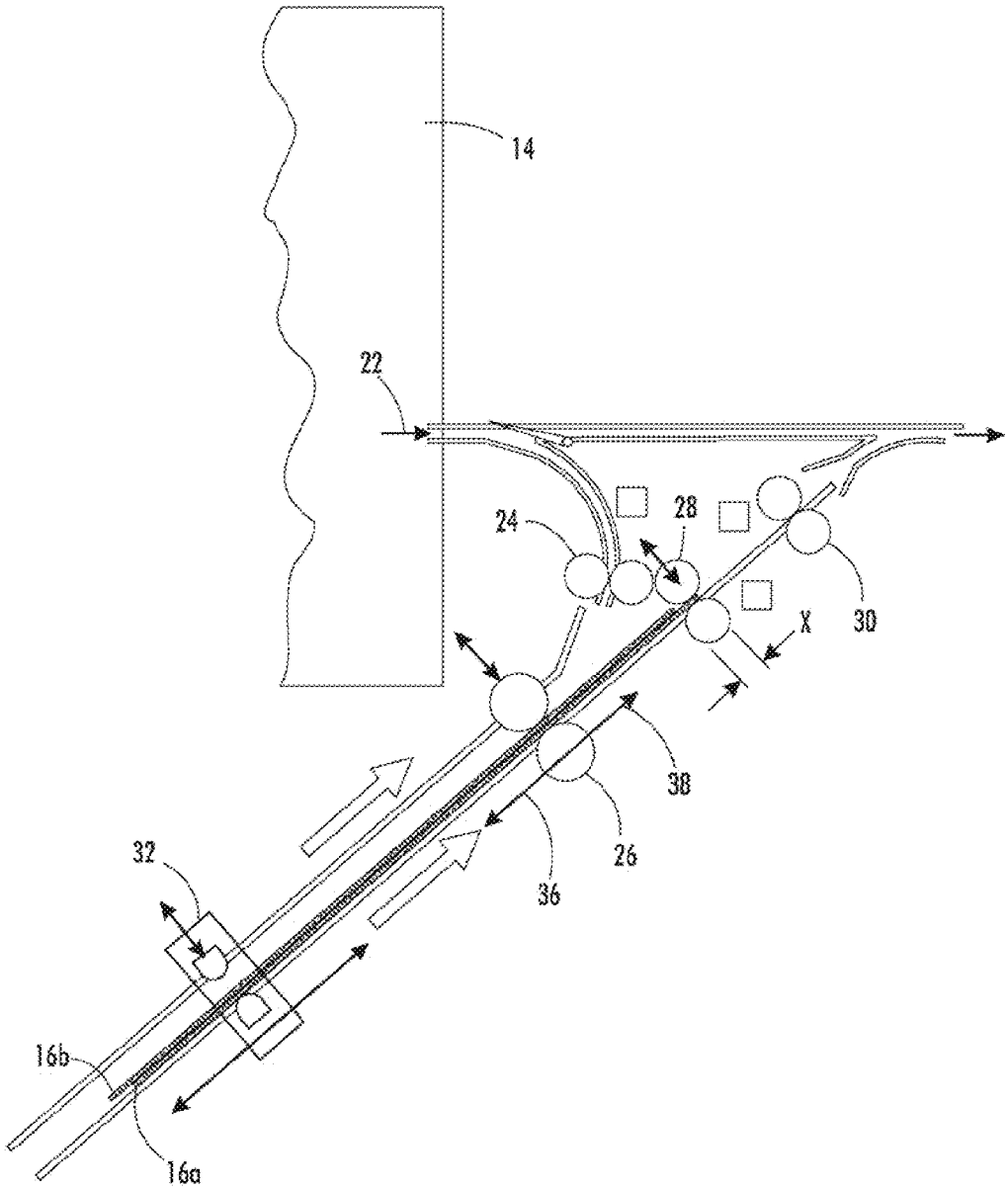

With reference to FIG. 6, after the second sheet 16*b* clears the entrance nip assembly 24, the movement of both sheets 16*a* and 16*b* is reversed and all the sheets are driven in a second direction 38 by the closed buffer nip assembly 26. The first and second sheets 16*a*, 16*b* are driven in the second direction 38 away from the collecting area 42 until both sheets are engaged by the holding nip assembly 28. The sheets may be aligned in a shingled configuration so that the leading edge of the first sheet 16*a* extends out the distance X in the second direction further than the leading edge of the second sheet 16*b*.

Figure 7:
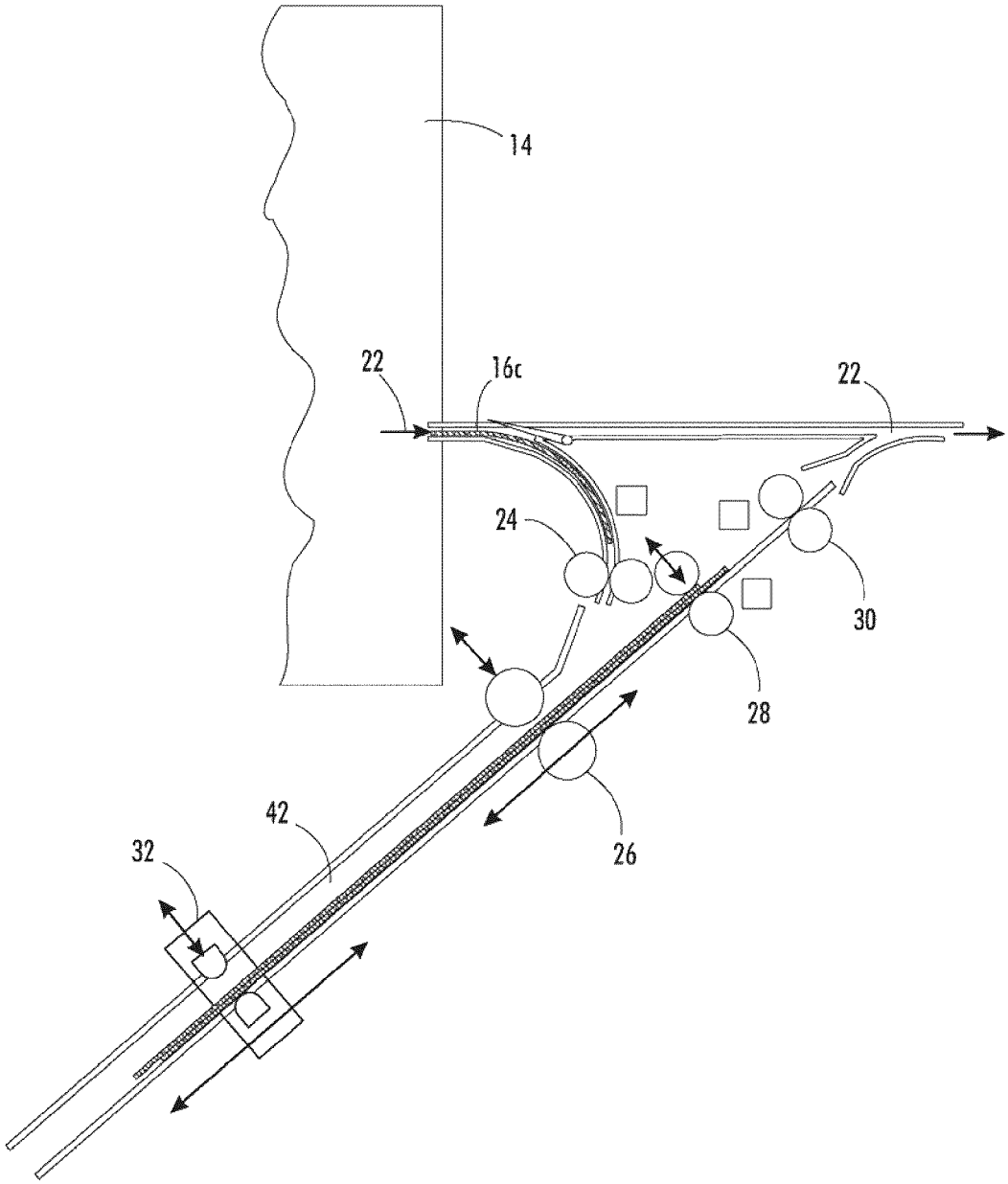

With reference to FIG. 7, additional sheets 16*c* may be added to the buffer and inverted one at a time in the same manner as the first and second sheets, 16*a* and 16*b*. Each new sheet is transported in the first direction 36 by the entrance nip assembly 24 and merged with the sheets that are already in the inverter-buffer using the process described with regard to FIG. 5 such that all the sheets are moved in the first direction 36 until the new sheet 16*c* clears the entrance nip assembly 24 and then the stack of sheets are moved in the second direction 38 toward the holding nip assembly 28 and when the second direction leading edge of the top, or newly added, sheet enters and is under the control of the holding nip assembly 28, the stack of sheets is stopped. The set of overlying sheets 16 are held by the holding nip assembly 28 in an offset shingled formation with the leading edge of each sheet being offset from the sheets adjacent to it by the dimension X (FIG. 6).

Figure 8:
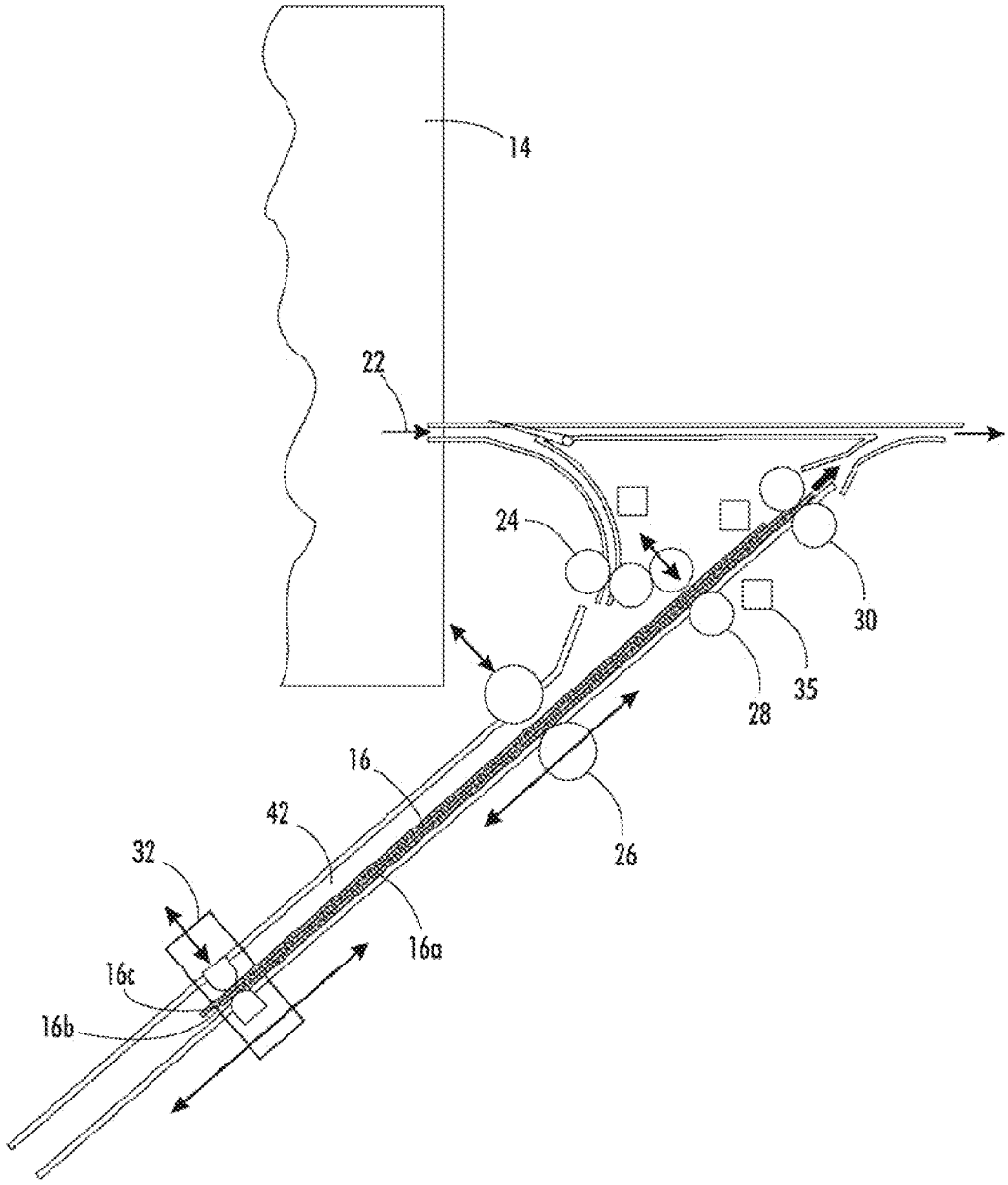

When the print engine 14 is energized, a number of sheets may be processed with images and fed into the buffer 20. The sheets 16 may then be held there and then feed back into the processing steam 22 as needed. With reference to FIG. 8, in order to eject the sheets from the buffer 20 and back into the processing stream 22, the shingled set of sheets is driven in the second direction 38 until the leading edge of the bottom sheet 16*a* engages the take away nip assembly 30. Sensors 35 monitor the sheet location so that the operation of the various nip assemblies may be controlled to obtain the desired sheet positioning. The set clamp 32 is disposed in the collecting area 42 with the sheets being in engagement therewith. The set clamp 32 may be translated along the length of the collecting area 42 to a position which is dependant upon the length of the sheets being processed. This can be done at the beginning of the job before sheets enter the inverter-buffer system. The set clamp position may be such that is engages the sheets toward the trailing edges of the sheets. The set clamp 32 is actuated and due to its position relative to the stack of sheets, it grabs all the sheets except the bottom sheet 16*a*, which is held by its leading edge in take away nip assembly 30. The buffer nip assembly 26 and the holding nip assembly 28 are opened and upon operation of the take way nip assembly 30 the first sheet 16*a* is transported out of the buffer into the processing stream 22. The clamp 32 prevents the remaining sheets from being pulled along with the sheet engaged by the take away nip assembly 30. Therefore, only one sheet is unloaded from the buffer at a time.

Figure 9:
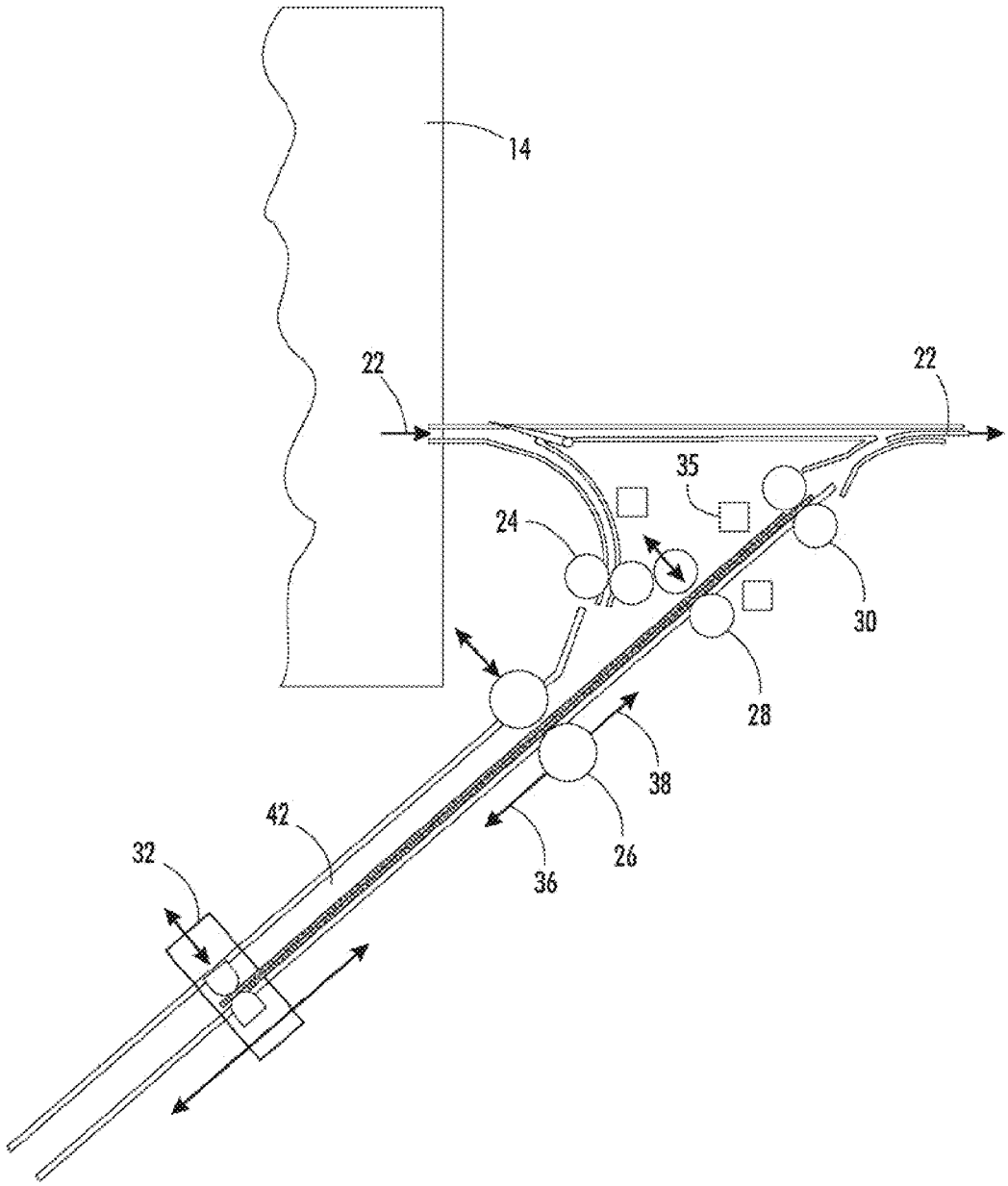

With reference to FIG. 9, in order to unload additional sheets from the buffer 20, the sheet set is indexed in the second direction 38 by operation of the buffer nip assembly 26 until the leading edge of the bottom sheet is at the take away nip assembly 30. Again, the set clamp 32 is actuated to hold all the sheets except the bottom sheet and the buffer nip assembly 26 and holding nip assembly 28 are released and the bottom sheet may be driven by the take away nip assembly 30 into the processing stream 22. After a sheet is ejected, new sheets may be added to the stack in the same manner described above with regard to FIGS. 2-5. The buffered sheets 16 are transported wherein the leading edges are engaged by the holding nip assembly 28 and with the buffer nip assembly 26 initially open, a new sheet is driven by the entrance nip assembly 24 into the buffer 20.

Figure 10:
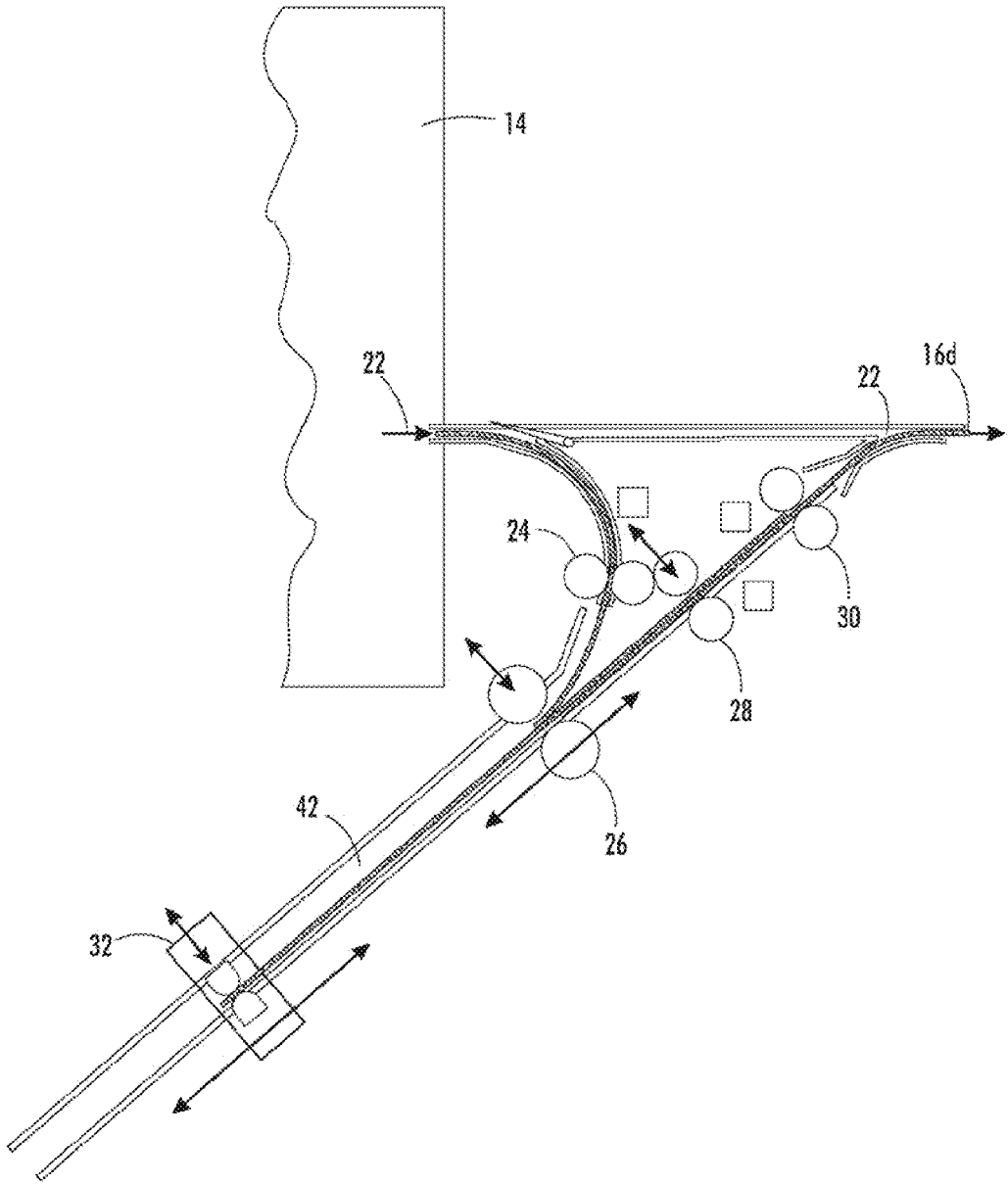
Figure 11:
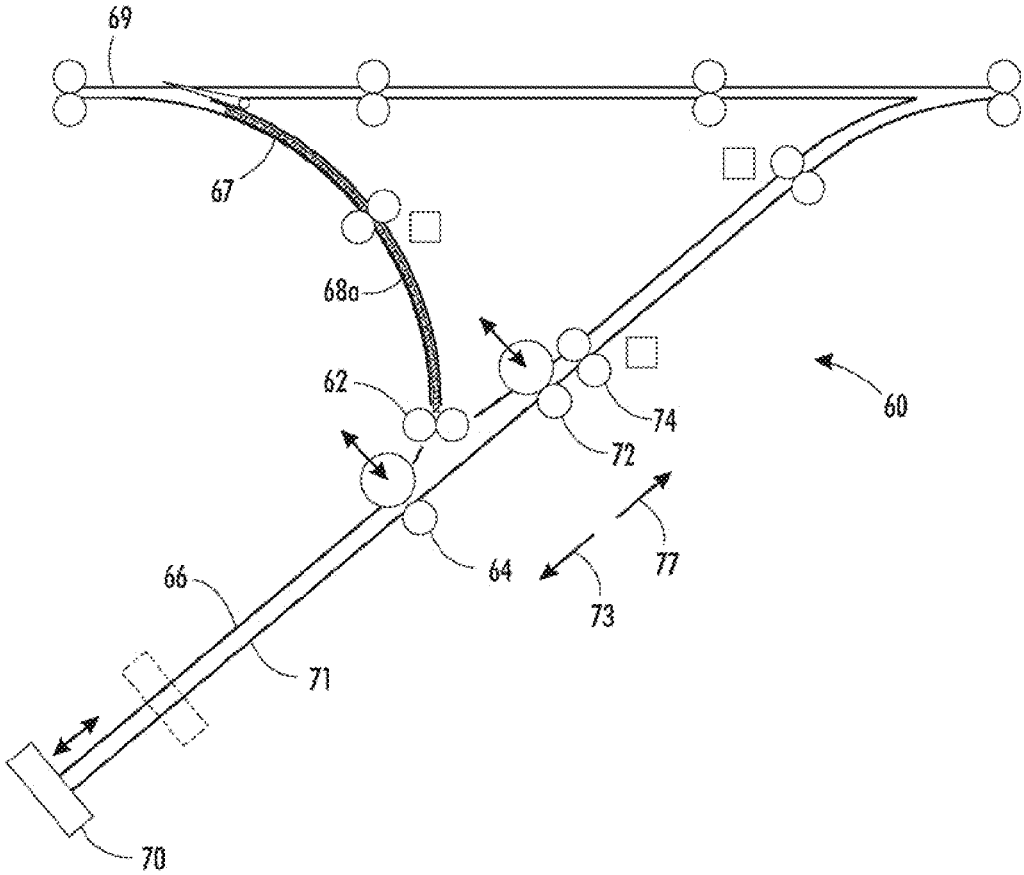
FIGS. 11-22 are schematic views of another embodiment of a sheet inverter/buffer depicting various stages of processing substrate media.
Figure 12:
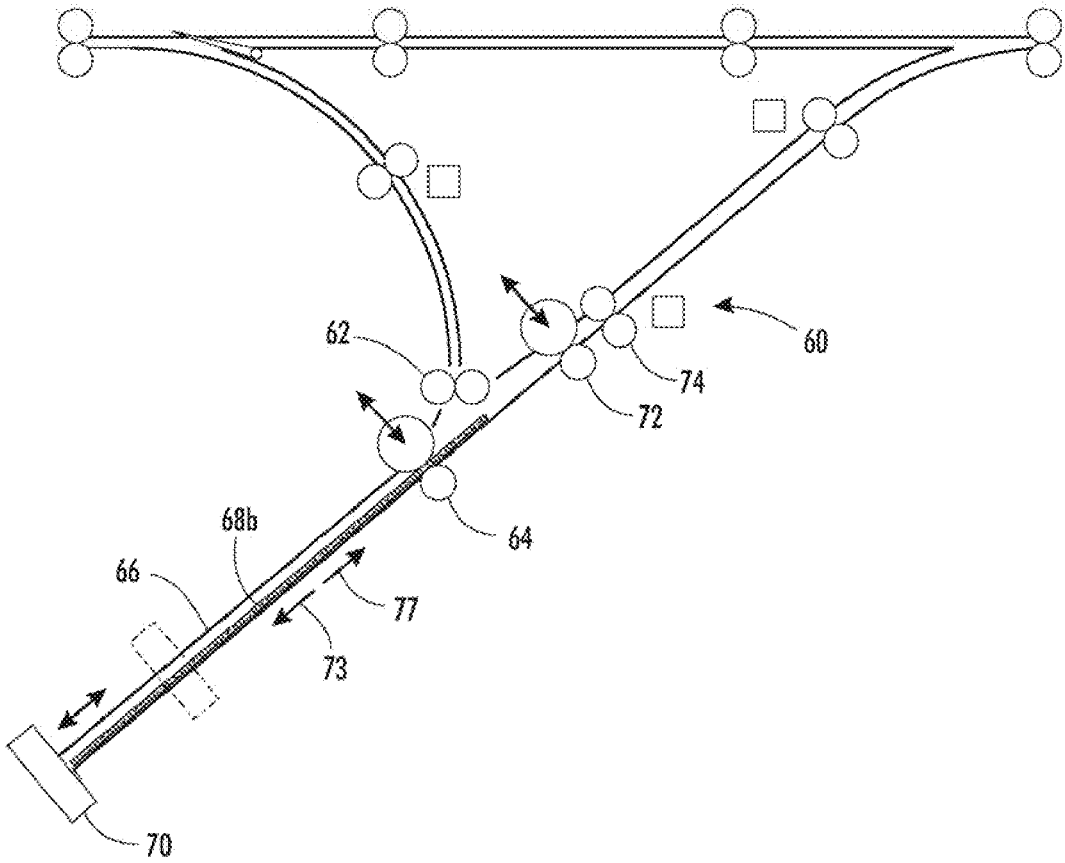

Referring to FIG. 10, in some applications it may be desirably to simultaneously load and unload the buffer 20. This is possible since the buffer nip assembly 26 is open during both the loading and unloading operation. In the simultaneous operation, the set clamp is open before the leading edge of an entering sheet reaches it. The trailing edge of an exiting sheet leaves the buffer nip assembly 26 before the buffer nip assembly 26 is closed to drive the set of sheets in the first direction. Accordingly, sheets can be loaded and unloaded to and from the buffer 20 to accommodate a wide variety of document processing jobs.

It should be appreciated that the system shown in FIGS. 2-10 is also capable of inverting one sheet at a time when the additional buffering operation is not required. For example, if the system of FIG. 1 was running a job that consisted of all color sheets, every sheet would individually be delivered to the inverter, reversed by buffer nip assembly 26 and delivered to the output path. It should further be appreciated that alternate drive means, such as belt transports, vacuum transports or translating clamp systems could alternately be used in place of the drive nip assemblies shown in FIGS. 2-10.

A further embodiment is shown in FIGS. 11-22. With specific reference to FIG. 11, buffer 60 includes an entrance nip assembly 62, an articulated bidirectional buffer nip assembly 64, and a sheet collecting area 66. A first sheet 68*a* is diverted from the processing stream 69 onto a curved first media path 67 where the sheet is lead toward the entrance nip assembly 62. The sheet is further transported past the buffer nip assembly 64 in a first direction 73 into the collecting area 66 (FIG. 12) and into a second media path 71. The transportation of the sheet along the first and second paths 67 and 71 inverts the sheet. An adjustable tamper stop 70 may be located at the bottom of the collecting area 66 and the leading edge of the sheet is driven until it comes to rest against the tamper stop.

Figure 13:
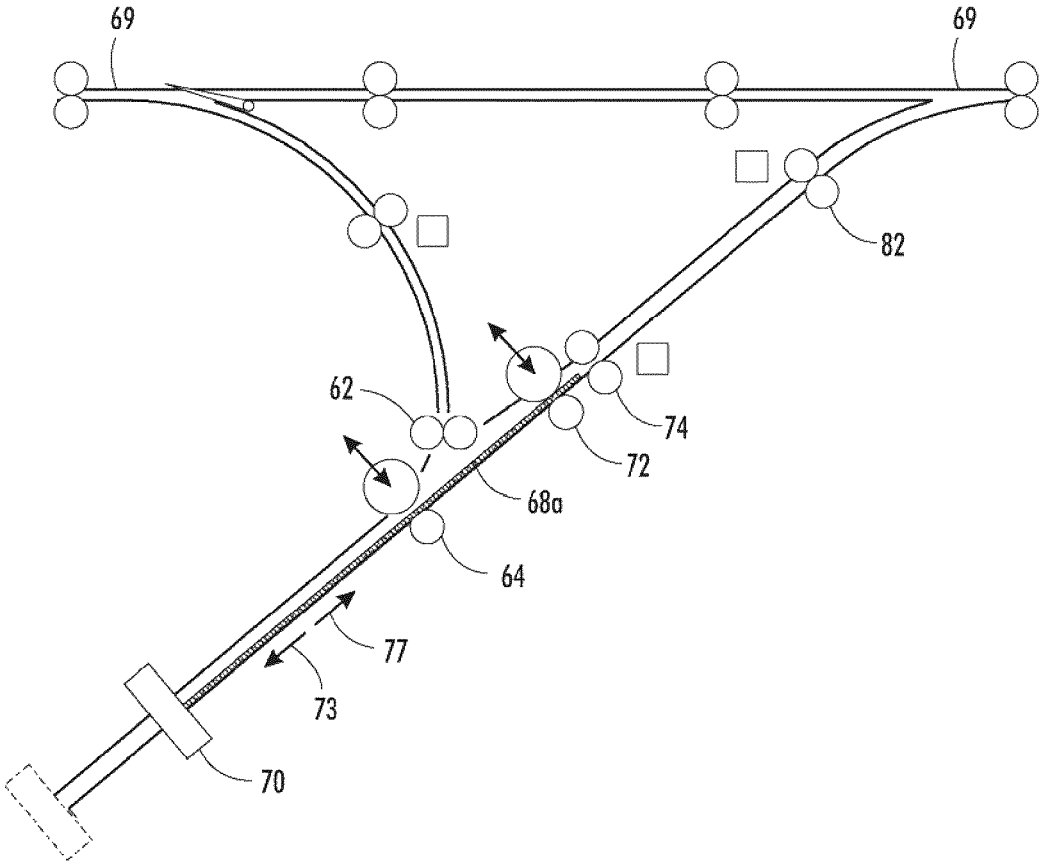
Figure 14:
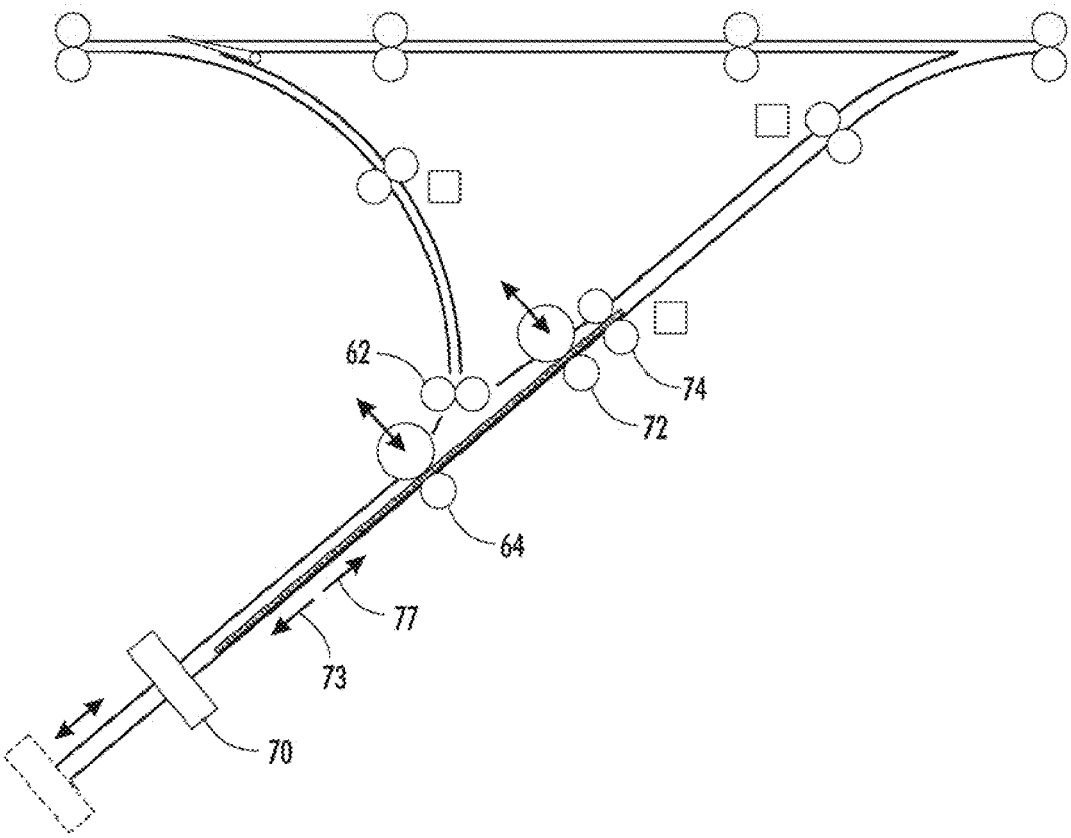

With references to FIG. 13, buffer nip assembly 64 is opened allowing the tamper stop 70 which then moves in the second direction 77 to drive the first sheet 68*a* toward the articulated bidirectional first holding nip assembly 72. The leading edge of sheet 68*a* enters the open first holding nip assembly 72 which then closes and begins to drive the sheet 68*a* in the second direction 77 whereby the sheet 68*a* is advanced by operation of the first holding nip assembly 72 toward a second holding nip assembly 74 as shown in FIG. 14. The tamper stop 70 is then retracted in the first direction 73 to its initial position and is ready to receive the next sheet.

Figure 15:
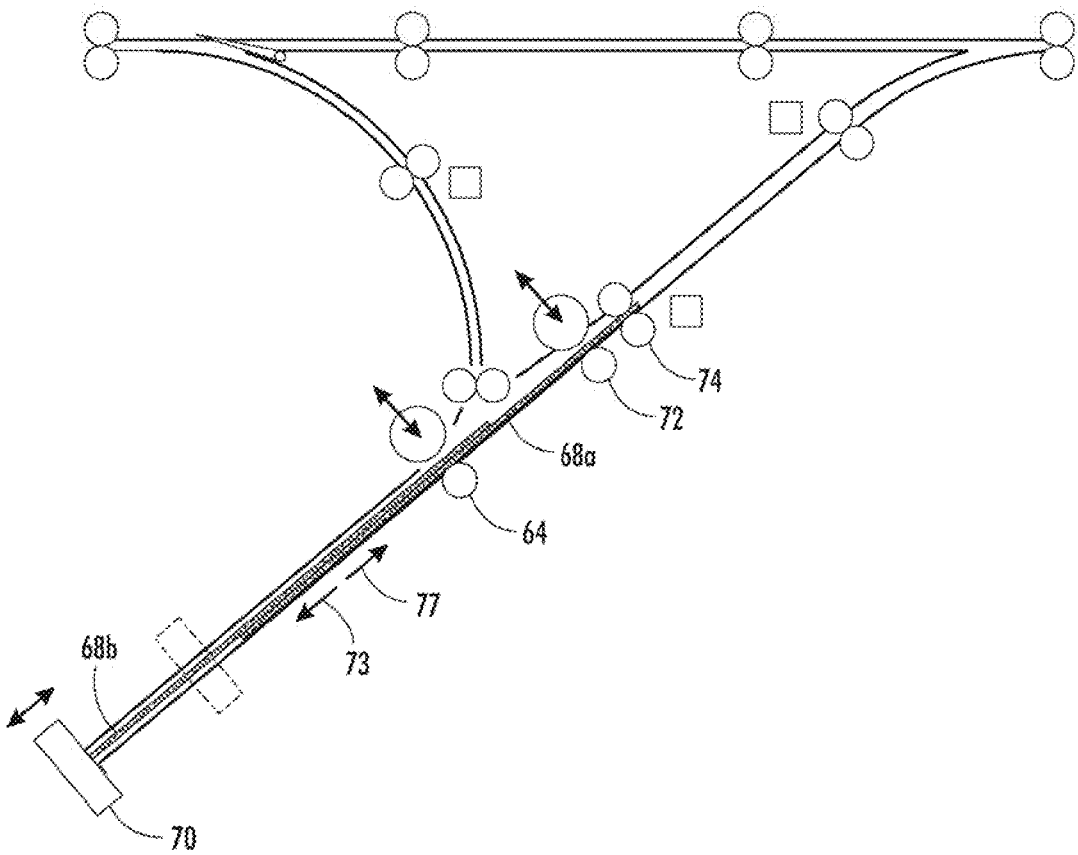
Figure 16:
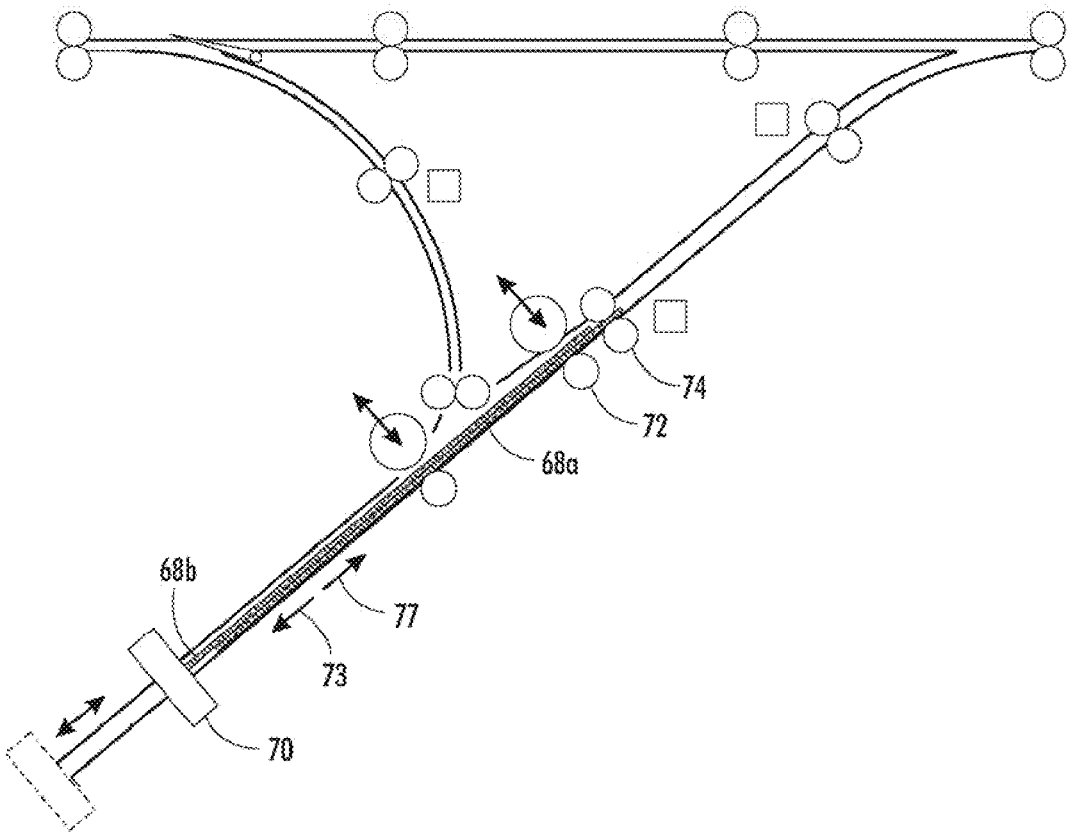
Figure 17:
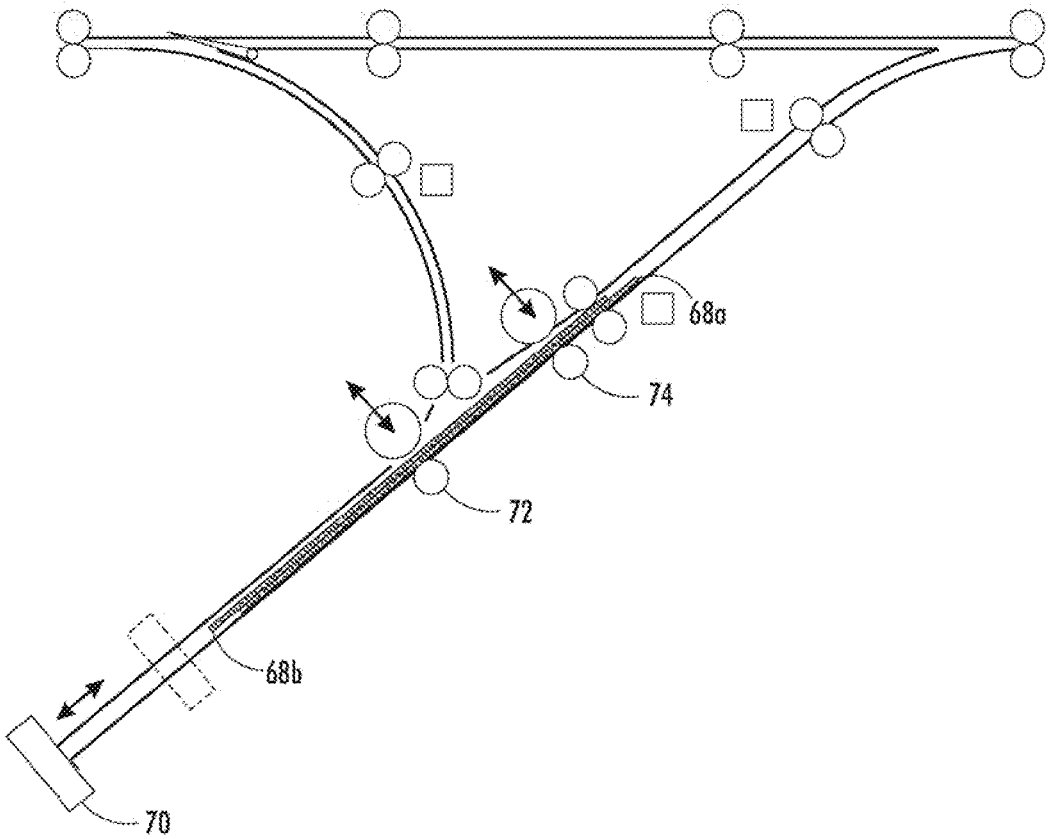

With reference to FIG. 15, a second sheet 68*b* may enter the buffer 60 passing through the entrance nip assembly 62 and buffer nip assembly 64 and engaging the tamper stop 70. The tamper stop 70 may move in the second direction 77 extending to drive the sheet into the open first holding nip assembly 72 as shown in FIG. 16. The first and second holding nip assemblies 72 and 74 may be activated advancing the sheets 68*a* and 68*b* toward the second direction 77. The sheets are advanced in the second direction 77 until the first and second sheets 68*a* and 68*b* are engaged by the second holding nip assembly 74, as shown in FIG. 17. The tamper stop 70 may then be retracted to it initial position. The first and second sheets 68*a* and 68*b* overlie each other and have offset edges.

Figure 18:
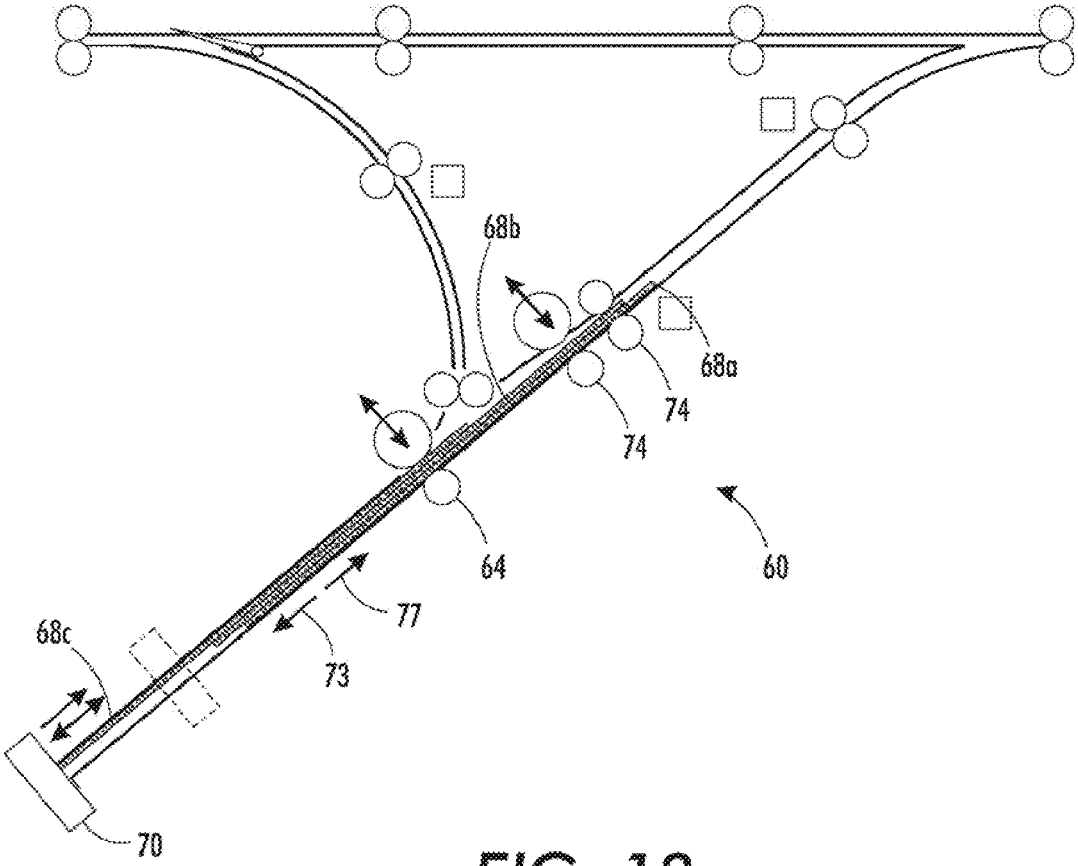
Figure 19:
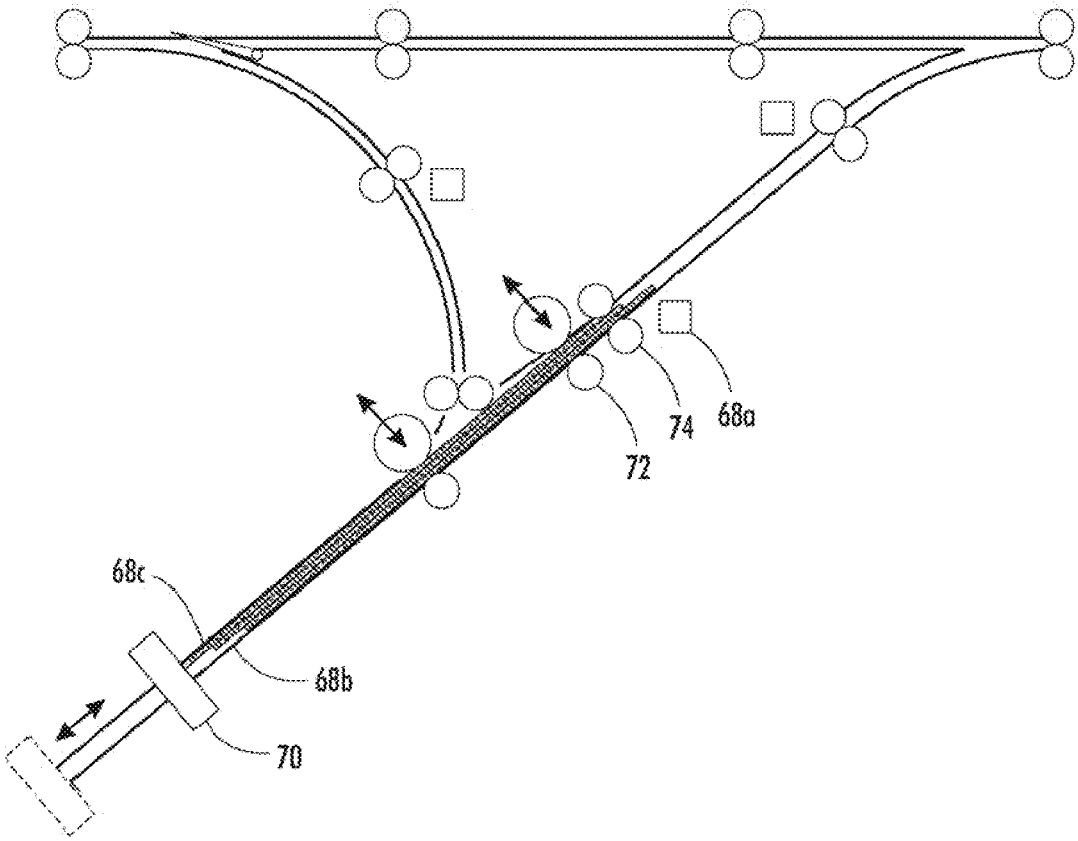
Figure 20:
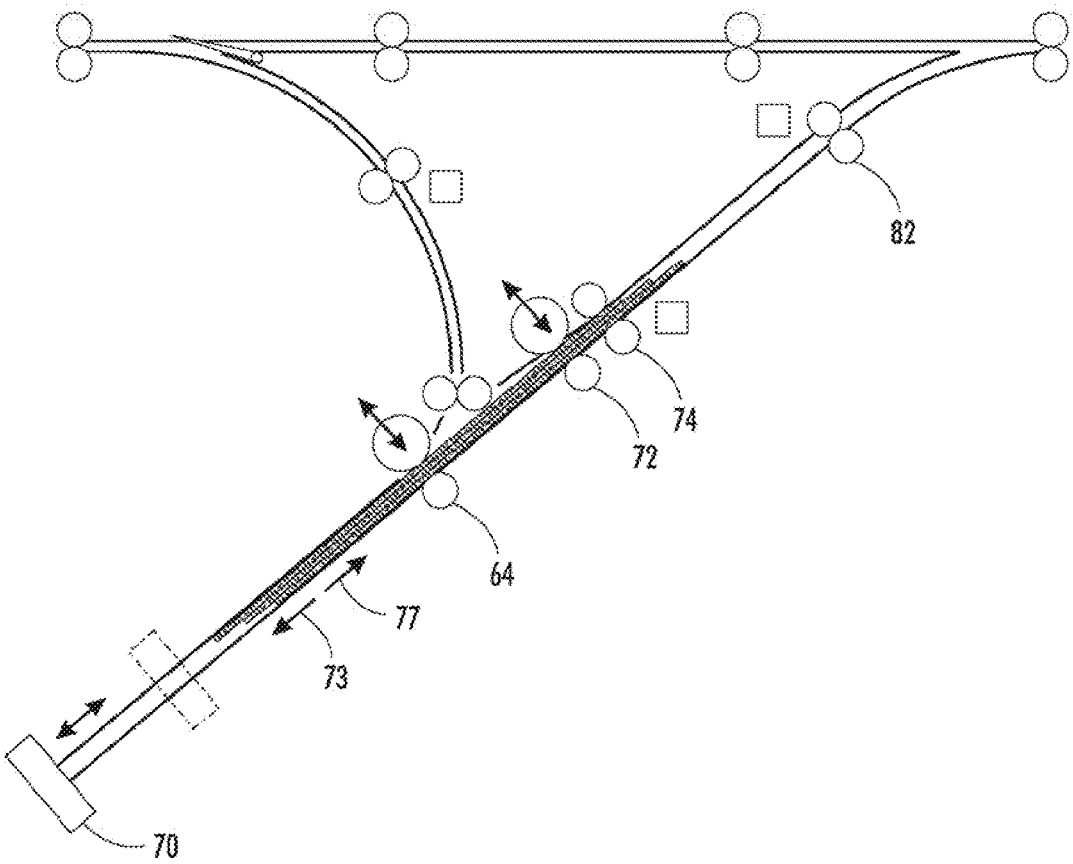

With reference to FIG. 18, a third sheet 68*c* may then enter buffer 60 engaging the tamper stop 70. The tamper stop 70 moves in the second direction 77 and pushes the third sheet 68*c* forward until it enters the open first holding nip assembly 72 as shown in FIG. 19. The first and second holding nip assemblies 72, 74 may then again be activated to drive all the sheets in the second direction until the third or top sheet 68*c* is engaged by the second holding nip assembly as shown in FIG. 20. In this manner, a shingled set of sets, with each sheet being offset from the others, is compiled in the buffer 60.

Figure 21:
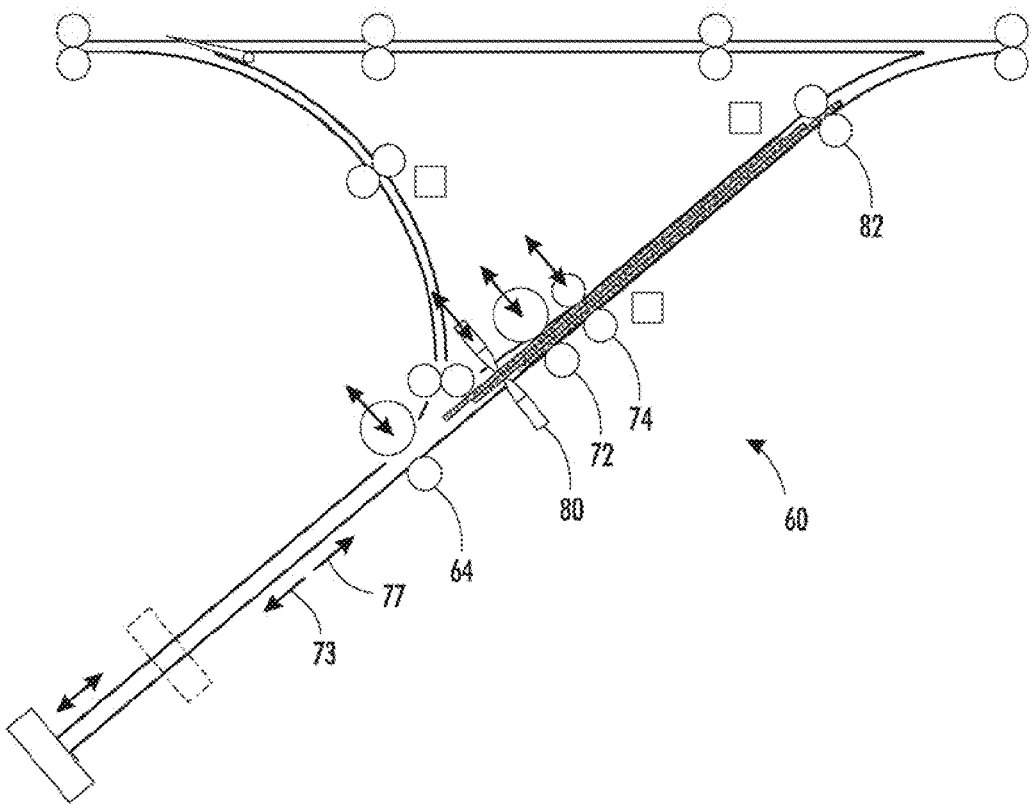
Figure 22:
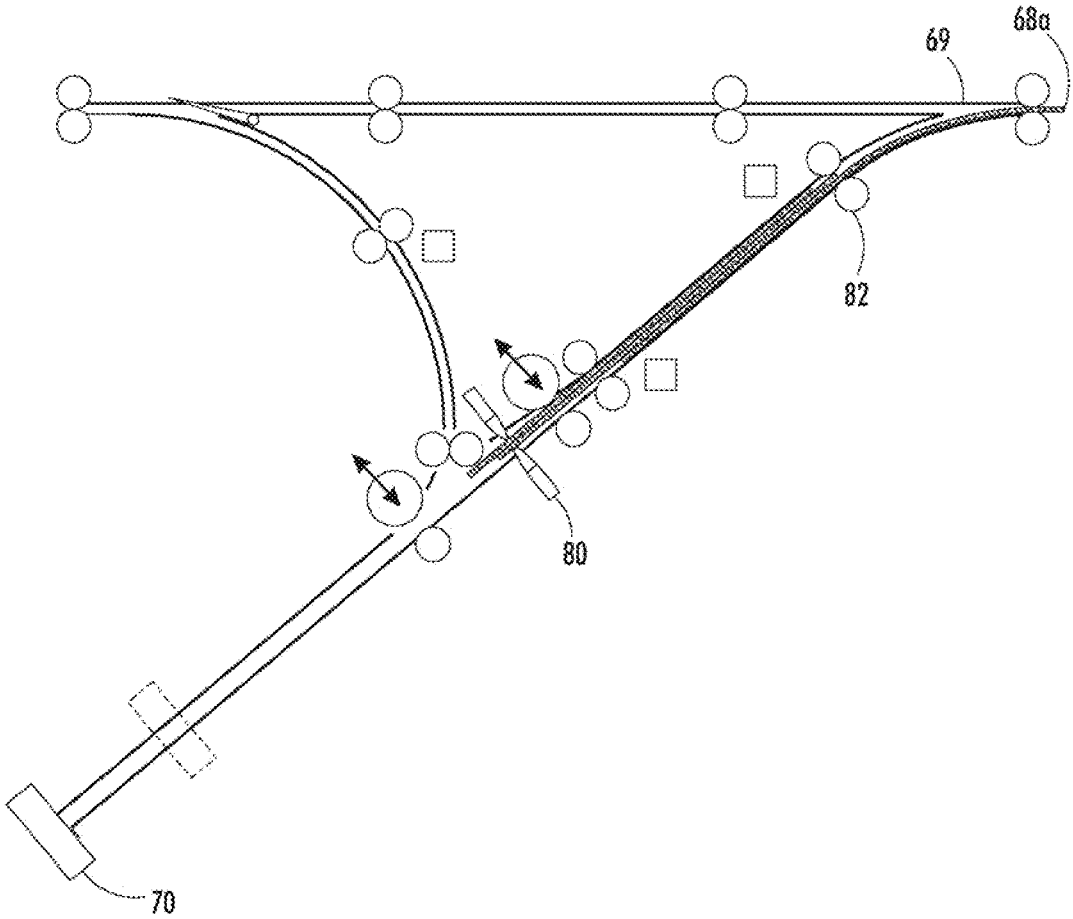

With reference to FIG. 21, a clamp 80 may be disposed toward the trailing edge of the stack of sheets 68 at a distance greater than one sheet length from take away nip assembly 82. The stack of sheets 68 may be advanced in the second direction 77 by operation of the buffer nip assembly 64 and the first and second holding nip assemblies 72, 74 until the first sheet 68*a*, i.e., the bottom sheet on the stack, engages a take away nip assembly 82. In this position, the clamp may be engaged to secure all of the sheets in the stack except for the first sheet 68*a*. The first sheet on the bottom of the stack may be unloaded from the buffer 60 upon opening of the buffer nip assembly 64 and the first and second hold nip assemblies 72 and 74 and by the actuation of the take away nip assembly 82 such that the sheet reenters the sheet processing stream 69 as shown in FIG. 22. The remaining sheets may be indexed forward until the bottom most sheet is engaged by the take away nip assembly 82. This action may be accomplished by actuation of the first and second holding nip assemblies 72, 74 and releasing the clamp 80. The other sheets in the buffer 60 may be unloaded in a similar manner wherein the bottom most sheet is driven in the second direction by the take away nip assembly 82 and the remaining sheets are held by the clamp 80.

The buffer of the present disclosure may be used in a wide variety of applications where multi-sheet buffering device is desired, and is not limited to only the applications described herein. For example, when a jam occurs in a single engine or multi-engine printing system the system cycles down and the jammed sheet is usually purged by the operator. There are often printed sheets in the paper path upstream of the jammed sheet, however since these are now out of order they are typically wasted or purged and then reprinted after the machine cycles back up. If a multi-sheet buffer was present in the exit path of the system, the upstream sheets could be delivered to and stored in the buffer, the sheet that jammed could then be re-printed and the buffered sheets released from the buffer to re-enter the job stream. This operation would save paper and eliminate the need to re-print as many sheets after a jam.

It will be appreciated that various of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the disclosed embodiments.

What is claimed is:

1. A system for buffering sheets of substrate media comprising:

a first sheet drive for transporting sheets into a sheet collecting area;

a second sheet drive selectively operable to transport the sheets in a first and second direction along a processing path, the second sheet drive including an open position wherein the second sheet drive does not engage the sheets and a closed position wherein the second sheet drive engages the sheets;

a holding device for holding a plurality of sheets, the second sheet drive and holding device cooperating to compile the plurality of sheets into a stack wherein the sheets overlie at least a portion of each other in a shingled manner; and a take away drive device in operative communication with the sheets for unloading the sheets from the sheet collecting area wherein the sheets exiting the collecting area are inverted with respect to their original orientation.

2. The system as defined in claim 1 , wherein the second sheet drive transports a sheet in a second direction into the holding device.

3. The system as defined in claim 1, wherein the second sheet drive and holding device cooperate to stack the sheets such that leading edges of the sheets are offset from each other along the processing path.

4. The system as defined in claim 1, wherein the second sheet drive is operable to move the stack of sheets in the second direction toward the take away drive.

5. The system as defined in claim 4, further including a clamp disposed adjacent the sheet collecting area, the clamp operable to selectively engage one or more of the plurality of sheets.

6. The system as defined in claim 5, wherein the take away drive and clamp cooperate to selectively transports the sheets out of the sheet collecting area one sheet at a time.

7. The system as defined in claim 1, wherein the first and second sheet drives include nip assemblies.

8. A sheet handling device comprising:

a first sheet path and a second sheet path, the first and second sheet paths cooperating to invert a sheet;

a sheet collecting area disposed along the second sheet path for holding and buffering sheets a first sheet drive for moving media toward the sheet collecting area;

a second sheet drive for moving the sheets in a first and second direction along the second path; and a holding device for retaining the sheets in a predetermined position, wherein the second sheet drive and holding device are configured to selectively operate to to form a stack of sheets having edges offset from each other in a shingled manner.

9. The device as defined in claim 8, including a take away drive for transporting the sheets out of the sheet collecting area.

10. The device as defined in claim 9, wherein the second sheet drive, holding device, and take away drive cooperate to receive a sheet into the sheet collecting area and substantially simultaneously transport a sheet out of the sheet collecting area.

11. The device as defined in claim 9, further including a clamp for selectively clamping and releasing the sheets, wherein the clamp and take away drive cooperate to selectively transport sheets out of the sheet collecting area one at a time.

12. A method of buffering sheets comprising:

transporting a first sheet from a sheet processing stream toward a sheet drive;

transporting the first sheet in a first direction into a sheet collecting area;

transporting the first sheet in a second direction along a processing path toward and into a first holding device;

retaining the first sheet in the sheet collecting area with the first holding device;

transporting a second sheet from the sheet processing stream into the sheet collecting area and toward the sheet drive;

transporting the second sheet in the second direction along the processing path toward and into the first holding device;

holding the first and second sheets in the sheet collecting area, wherein the second sheet overlies at least a portion of the first sheet; and selectively transporting the first and second sheets along the processing path out of the sheet collecting area and back into the sheet processing stream one at a time.

13. The method as defined in claim 12, wherein the second sheet upon entering the collecting area is offset in a shingled manner from the first sheet in a direction along the processing path.

14. The method as defined in claim 13, including opening the sheet drive to allow the second sheet to enter the sheet collecting area and responsive to a position of the second sheet, closing the sheet drive and transporting the first and second sheets in the second direction toward and into the first holding device.

15. The method as defined in claim 14, including transporting the first and second sheets in the second direction toward a take away drive wherein the take away drive engages a leading edge of the first sheet and does not engage the second sheet.

16. The method as defined in claim 12, including positioning a sheet clamp along the sheet collecting area at a location responsive to a sheet length and activating the sheet clamp to engage the second sheet and activating the take away drive to transport the first sheet into the sheet processing stream.

17. The method of claim 12, wherein a stop tamper is disposed in the sheet collecting area and translatable between an extended and retracted, the stop tamper is engagable with the first and second sheets.

18. The method of claim 17, including extending the stop tamper to transport the first sheet toward and into the first holding device, and retaining a leading edge of the first sheet with a second holding device; activating the stop tamper and moving the second sheet toward and into the first holding device, and activating the first and second holding devices to move the first and second sheets in the second direction, wherein that the first and second sheets are offset in a shingled manner from each other along the processing path.

19. The method of claim 12, including inverting the first and second sheets prior to transporting the first and second sheets back into the sheet processing stream.

20. The device as defined in claim 8, wherein the holding device has a closed position for retaining the position of at least one of the sheets as the second sheet drive engages a second sheet and propels the second sheet toward the sheet collecting area.

21. The device as defined in claim 8, wherein the holding device selectively opens and closes in coordination with the operation of the second sheet drive to form the shingled sheet stack.

* * * * *